United States Patent [19]

Villanueva

[11] 4,421,433

[45] Dec. 20, 1983

[54] HYGIENIC TOOTHBRUSH COMPRISING A CONTAINER FOR DENTIFRICE SUBSTANCES

[76] Inventor: Gilberto M. Villanueva, Calle de Carnero No. 5384, Guadalajara, Jalisco, Mexico

[21] Appl. No.: 210,641

[22] Filed: Nov. 26, 1980

[51] Int. Cl.[3] ..... A46B 11/02

[52] U.S. Cl. ..... 401/175; 401/276; 401/286; 222/390

[58] Field of Search ..... 401/175, 276, 286; 222/390

[56] References Cited

U.S. PATENT DOCUMENTS

| | | | |
|---|---|---|---|
| 910,970 | 1/1909 | Stryker | 401/175 |
| 1,274,957 | 8/1918 | Tibbals | 222/390 |
| 1,336,390 | 4/1920 | Sargery | 401/175 |
| 1,478,332 | 12/1923 | Gaarder | 401/175 |
| 1,486,394 | 3/1924 | Smith | 401/175 |
| 1,692,096 | 11/1928 | Scott | 222/390 |
| 1,902,859 | 3/1933 | Joseph | 401/175 |
| 2,723,411 | 11/1955 | Ellis | 401/276 |
| 3,039,476 | 6/1962 | Reitknecht | 401/175 |
| 3,281,024 | 10/1966 | Henchert | 220/359 |

FOREIGN PATENT DOCUMENTS

| | | | |
|---|---|---|---|
| 390971 | 8/1908 | France | 401/279 |
| 930012 | 7/1947 | France | 401/175 |

*Primary Examiner*—Clyde I. Coughenour
*Attorney, Agent, or Firm*—Ladas & Parry

[57] ABSTRACT

A hygienic toothbrush having a hollow handle portion for storing dentifrice. A cover for a first end having an aperture therein with a bar passing through the aperture into the interior of the handle portion and having a portion exterior thereof with a knob. A plunger movably secured to the interior portion of the bar having a threaded interior opening to complement the threads on the bar. A vent comprising a first and a second orifice through which the first and second pins extend, the first pin being larger than the second pin and of sufficient length to contact the plunger, the second pin being of insufficient length to contact the plunger, with a rod connecting the first and second pins. A brushing member removably secured to the handle portion having a brushing surface and a conduit leading from the handle portion to the brushing surface.

10 Claims, 8 Drawing Figures

HYGIENIC TOOTHBRUSH COMPRISING A CONTAINER FOR DENTIFRICE SUBSTANCES

This invention refers to improvements in hygienic toothbrushes comprising a container for dentifrice substances which can be carried as a fountain pen and also provided with means and mechanisms operated to eject the toothpaste within the container through an interior orifice included in the toothbrush until such substance exits from one or several orifices in the area occupied by the Nylon fibre bristles forming such brush, placing the toothpaste in the position required for its use. Thereafter rinsing such brush with water as normally effected and covered with a cap of cover, remaining hygienically protected from environmental contamination until the brush is to be used again; when the contents in the container or brush feeding chamber becomes exhausted, such container may be reloaded with the user's favorite toothpaste as often as necessary thereby converting this brush in a useful and hygienic article, which may be manufactured in any form or size with the adequate materials always within the basic scope of the invention which consists of the toothbrush comprising a container for dentifrice substances, which are ejected therefrom by means and mechanisms at will, conveying such substances within the interior orifice of the brush until they are ejected from one or several orifices positioned in the area occupied by the tufts of fibres or bristles which form the toothbrush depositing such substance in the correct place for its use. Once the toothpaste in the container or storage chamber has become exhausted it can be reloaded with the desired toothpaste as often as necessary.

The object of the present invention is to enable a person to wash his teeth at anyplace where there is enough water for such purpose without having to carry the brush as well as the toothpaste which is unpractical and bothersome compared to the present brush which in one piece carries both things, conveniently and hygienically, the brush as well as the toothpaste, which is carried as a fountain pen and supplies the toothpaste in the position required for its use at will.

The improvements are characterized by:

1. A valve permitting the air to escape from the container while being loaded with toothpaste. The valve permits such loading easily since it is a chamber, hermetically sealed at one end by a plunger and the other end of which may be opened in order to introduce the toothpaste from the tube into the container under pressure. Due to the physical characteristics of toothpaste it is possible that the air therein may be compressed by the entrance of such toothpaste, thereby restraining such entrance. This problem is solved by the mentioned valve, which permits exit of the air preventing such reloading. The location of the valve is on the body of the container where it operates.

2. Two longitudinal orifices positioned near the base of the container and on the periphery thereof. The orifices are separated by a pre-determined space therebetween and provide communication from the exterior into the interior of the container, i.e. perforating the wall thickness of the container. The orifices are regulated with two protrusions or pins of an adequate form protruding from a thin, flexible spring-like bar or strip fabricated from an adequate material, and forming the valve since the protrusions and the bar are integrally formed. The outer protrusion closes the air outlet orifice when the container is flush with the wall thickness of the same, and the other closes the orifice and protrudes from the interior of the container since it has a length greater than the wall thickness. The portion of the other protrusions longer than the wall is thick, protrudes from the container interior, abuts the piston when it is operated to place the same at the container base, and rises thereby permitting the container to be reloaded with toothpaste at its base. The rising of the other protrusions causes the simultaneously raising of the protrusion or covering pin, and the opening of the air outlet orifice, thereby permitting the container to be reloaded. One end of the container includes a peripheral channel of convenient size and depth running longitudinally on the orifices, and is used to house the bar or strip forming the valve thereby making it possible to have the container periphery totally uniform without protrusions, forming a spring which rises and falls, opens or closes the air outlet orifices respectively in accordance with the action of the plunger on the outlet which such plunger abuts.

The container interior is generally of cylindrical form and is slit by one or more transverse members having an adequate size as may be convenient or required, in order to fasten the plunger, and in a manner whereby such plunger may move in both directions. The plunger having an axis consisting of a screw which travels either forward or backward throughout the entire length of the container interior as activated by a knob or button from the container exterior, such plunger being cylindrical and its periphery being slit by one or more transverse members as may be required, mating with the container interior, in a manner whereby such mating of the cross section form of the container interior and the periphery of the plunger permit the plunger to be moved readily in both directions in order to carry out its work whenever the knob is activated.

3. The provision of a plunger which moves within and throughout the entire length of the container interior, along an axis which is formed by a screw activated from the exterior by a knob or button, which makes the same move forward or in reverse in accordance with the requirements. Such piston having a peripheral form mating with the interior cross section of the container. Furthermore, one or more channels are slit into the plunger in order to house one or more rings or rubber straps or straps made from other materials in order to hermetically seal the container interior, such plunger having a theaded orifice wherein the screw activating the same is threaded.

4. The provision of a cover or casing coating the hollow portion of the toothbrush wherein the toothpaste travels in order to exit the brush. The cover is also hollow and thin, therefore coating the brush orifice and holding its same form. Such cover is fabricated from a non-hygroscopic and non-toxic material, thereby obtaining the possibility of having a storage pocket for the toothpaste or other dentifrice, fresh substance and isolated from any contamination.

The hygienic brush's detailed characteristics which comprise a storage chamber for toothpaste or other dentifrice substances, are clearly set forth in the following description and drawings illustrating the above mentioned description and the same reference numbers are used to show similar parts in the figures shown.

Figure 1A:
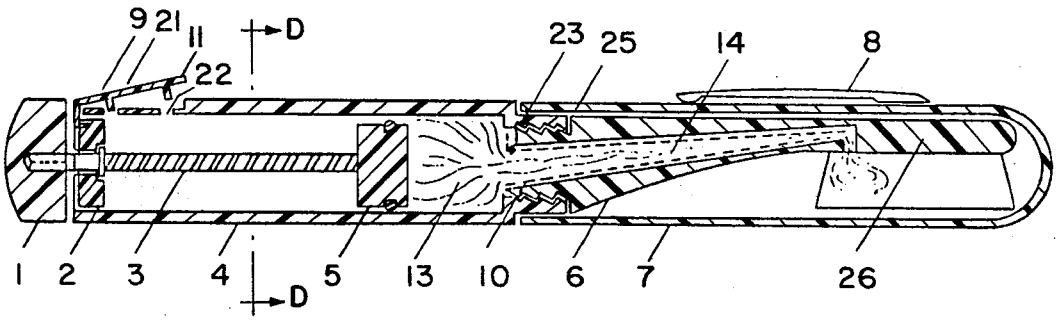
FIG. 1A is a view illustrating the brush in a conventional generally cross sectional view.
Figure 1B:
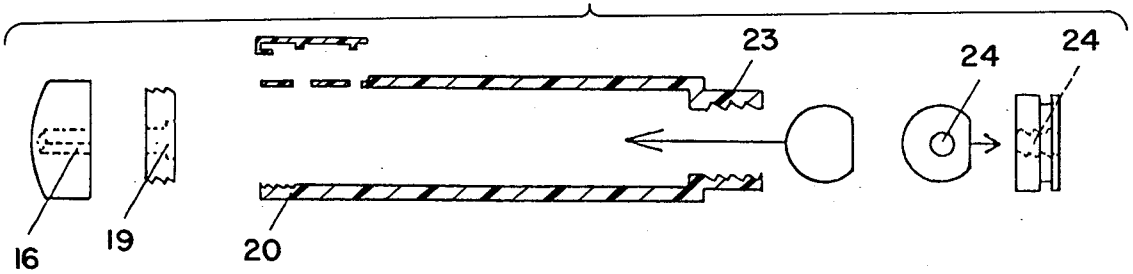
FIG. 1B is an exploded view of the parts of the brush of FIG. 1A showing some parts associated with the handle in cross section.
Figure 1C:
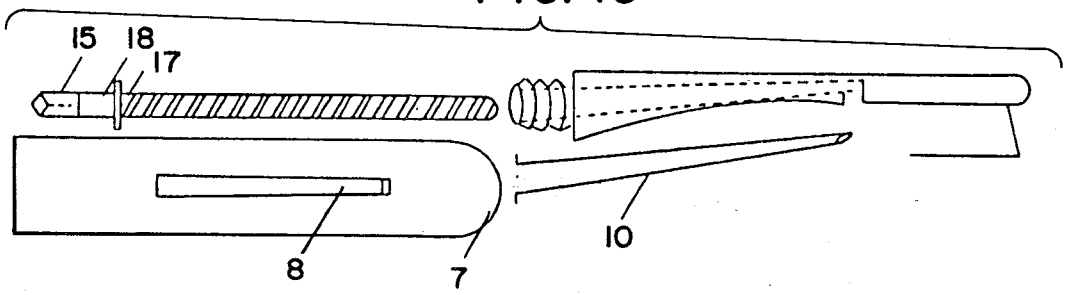
FIG. 1C is an exploded view showing the remaining parts of the brush, some of the parts being in cross section.
Figure 1D:
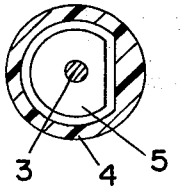
FIG. 1D is a view taken along line D—D of FIG. 1A.
Figure 1E:
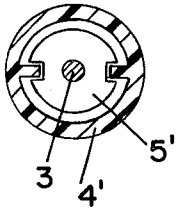
FIG. 1E is similar to FIG. 1D but illustrates an alternate embodiment of the invention.
Figure 2:
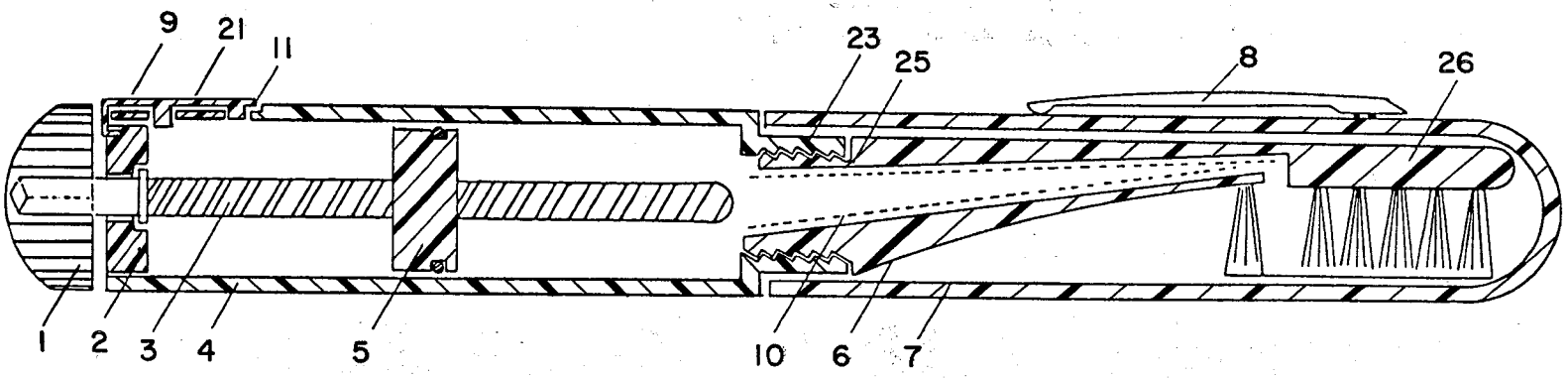
FIG. 2 is a view illustrating an empty brush in generally longitudinal cross section.
Figure 3:
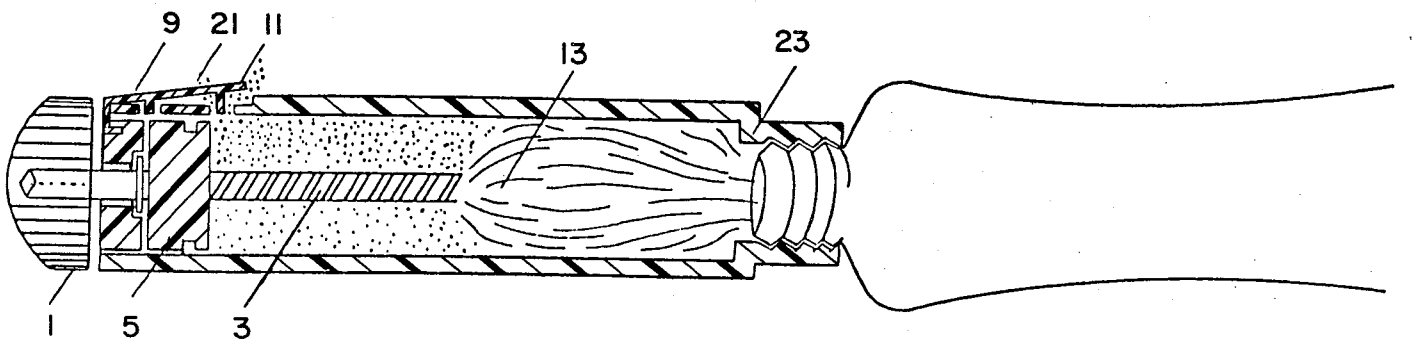
FIG. 3 is a view illustrating the brush while the same is being loaded and filled with toothpaste in generally longitudinal cross section.
Figure 4:
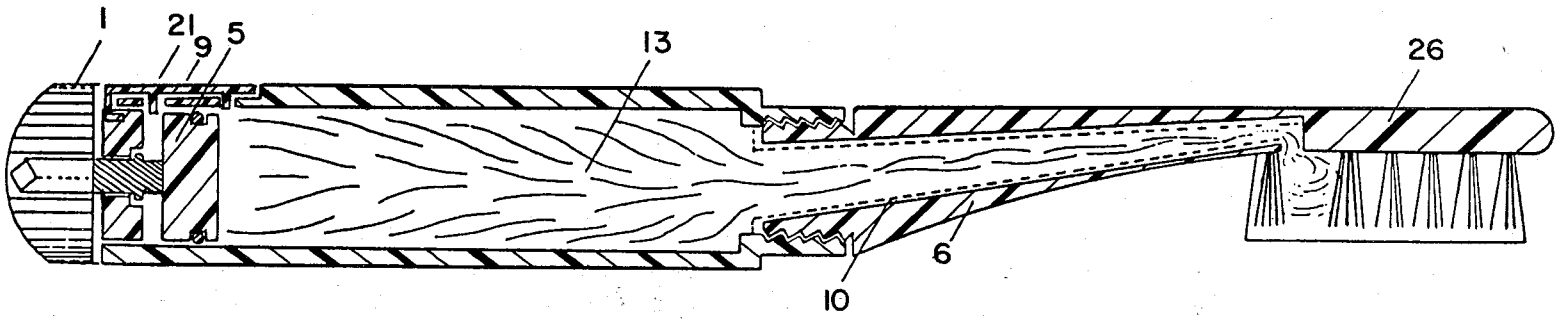
FIG. 4 is a view illustrating the brush in the completely full condition in a generally longitudinal cross section.

Number 1 represents a knob or button, which is activated by the user to effect a rotary motion to advance or reverse the plunger or nut 5 traveling along the screw or bar 3 in storage chamber or container interior 4 thereby permitting the ejection of the dentifrice substance 13 from the container. Such substance travels across the space 14 of the brush 6, and exits the same into the area of the fibre or bristle tufts forming the toothbrush.

This knob or button 1 is fastened by any means to the bar or screw end 15 which is introduced into the pocket 16 of the knob internal end. Member 2 is positioned midway between the knob and the support 17 of the bar or screw 3 freely transversed by the bar in its smooth portion 18 which corresponds to the orifice 19 of member 2. Such member is fastened to the end 20 of the storage chamber or container 4 in such a condition that when the member 2 is fastened to the knob and midway between the knob 1 and the bar support 17, it permits the knob to be activated in one or the other direction advancing or reversing the plunger 5 without moving the knob, which always remains in its place.

Numeral 2 represents the member which closes off the storage chamber or container 4 of the brush at one end 20 to which the bar or screw 3 is fastened and which includes a central orifice 19 wherein portion 18 is housed and permits its rotary motion of the same when such portion is activated from the exterior by the knob 1.

Numeral 3 identifies the threaded bar or screw which travels along the entire container interior 4, thereby advancing or reversing the plunger 5. Immediately after such threaded portion on the end which moves toward the exterior i.e. before the thread begins, the screw or bar has a support 17 protruding a short distance from the bar 3 diameter and which remains within the container. The bar continues its travel towards the exterior with a smooth portion (not threaded) in order to become housed within orifice 19 of member 2 in order to serve as a cover for terminal or end 20 of the container 4. Immediately after this smooth portion corresponding to the thickness of member 2 there is a square portion 15 penetrating into orifice 16 of the knob 1 to fasten the same for the purposes required, thereby being positioned between the bar 3 support 17 and the knob 1, and member 2 or container cover, the cover 2 has previously been described, by its central orifice 19, freely rotates the smooth portion 18 of the bar 3 securing the same, but not fastening the same for the required operation thereof and furthermore moving bar 3 upon the rotation of the knob 1, but without the displacement thereof.

Numeral 4 represents the member corresponding to the storage chamber or container having the toothpaste which in turn is used as the brush handle or support wherein such substance is housed; the part corresponding to the bar or screw 3, the plunger 5 with its rubber strap, the protruding portion which activates the air valve 21, the air outlet orifice 22 and the toothpaste 13. The end 23 of the container is open, displaying a threaded orifice which corresponds to the threaded end 25 of the brush member 6 which is held thereby to the container, jointly forming the brush. Furthermore, loading of toothpaste into the container is carried out through such end 23 which is effected as follows:

Once the toothpaste 13 has become exhausted within the container 4, the plunger 5 logically shall be abutting the end 22 thereof and therefore it shall be necessary to reverse the same until it reaches its base or end 20 where it will abut or contact the protruding portion or pin 21 of the air outlet valve. This contact rises this protruding portion on the exterior and simultaneously ejects the regulating portion 11 of the air outlet orifice 22 in order to have the air outlet valve operate in such conditions making the container ready to receive the toothpaste.

Before carrying out the previous operation, the brush 6 is unthreaded from its terminal end 25 and terminal end 22 of the container to immediately thereafter carry out the operation previously described, and return the plunger 5 to its original position and to leave the air valve 9 open. Thereafter, the toothpaste tube is engaged threadedly or otherwise to terminal end 23 of the container with a certain degree of pressure in order to have the toothpaste penetrate within the container, once such container is full the toothpaste tube is withdrawn and the brush member is threadingly engaged in its place, thereafter rotating the knob 1 to the right a short distance in order to move plunger 5 a short distance forward and leave its contact or engagement with the protruding portion or pin 21 of the valve, such descending to its normal closing position in orifice 22 of the air outlet, threadingly positioning the brush in order to be ready for use.

Numeral 5 represents the piston or plunger, which moves forward or in reverse on bar 3 within the container 4 by the activation of knob 1. Once the knob is rotated, the plunger advances forward on bar 3 ejecting the dentifrice in order to make it penetrate within orifice 14 of the brush member, such dentifrice traveling through the same and exiting at the required site, i.e., the bristle or fibre tuft area forming the brush portion thereof. Said plunger includes a threaded central orifice 24 which mates with the threaded bar 3 and furthermore includes one or more channels housing one or several rubber straps which hermetically seal container interior 4 where such channels traverse, thereby not permitting leaks nor the penetration of air which could damage the toothpaste.

Numeral 6 represents the member which corresponds to the brush portion of the invention, which includes a threaded terminal portion 25 threadingly engaged in container terminal 23, and terminal 26 is provided with a tuft or bristle assembly forming the brush itself which includes one or more orifices in order to permit the exit of the toothpaste. Such orifice or orifices connect with orifice 14. Member 6 forms a cover or shroud means that encompasses all the hollow portion, such shroud means is formed by an identical material as the one forming container 4, i.e., a non-hygroscopic, non-toxic material, thereby forming an enclosed storage pocket in order to preserve the toothpaste fresh and free from contamination.

Numeral 7 illustrates the cover or cap portion protecting the brush portion which is engaged to terminal 23 on the external part of container 4, by a pressure fit or any other adequate means in order to protect the brush from environmental contamination. Such cap or cover may include a "fastener" 8 in order to clip the brush in the user's pocket in the manner of a common fountain pen.

Numeral 9 represents a member having spring or flexible strapping characteristics, which include two protrusions or pins 21 and 22 projecting from one of its faces, 21 projecting further than 22. Such member in an assembled condition opens and closes the air outlet orifice and therefore forming a valve means. The opposite end of the pins are fixed on the container body and base by any appropriate means.

I claim:

1. A hygienic toothbrush comprising:

a hollow handle portion for storing dentifrice having a generally cylindrical interior and two open ends;

a cover for a first of said open ends, having first securing means thereon for securing said cover to said handle portion, and a first aperture therein;

a threaded bar passing through said first aperture into said interior of said handle portion and having a portion exterior thereof;

a knob rigidly secured to said exterior portion of said bar;

a plunger movably secured to said interior portion of said bar, and having a threaded interior to complement the thread of said bar;

a vent comprising a first and a second orifice through which first and second pins extend, said first pin being larger than said second pin, and of sufficient length to contact said plunger, said second pin being of insufficient length to contact said plunger, and further comprising a rod connecting said first and second pins, said rod being flexibly secured to said handle; and a brushing member removably secured to said handle portion by a second securing means located within said second open end of said handle portion, said brushing member comprising a brushing surface and a conduit leading from said second open end of said handle portion to said brushing surface.

2. A toothbrush of claim 1, wherein said second securing means comprises a threaded seal between said second open end of said handle portion and said brushing handle, with the thread thereof matching the thread of a standard toothpaste container.

3. A toothbrush of either claim 1 or 2, further comprising third securing means for securing said plunger against rotation.

4. A toothbrush of claim 3, wherein said third securing means comprises a matched set of guides on said interior of said handle portion and notches in said plunger.

5. A toothbrush of claim 3, wherein said third securing means comprises a flattened surface on said plunger and a matching flattened surface in said interior of said handle.

6. A toothbrush of either one of claims 1 or 2, wherein said plunger further comprises a seal to prevent the leakage of dentifrice across the length of said plunger.

7. A toothbrush of claim 6, wherein said seal comprises a groove on the periphery of said plunger in which is positioned a sealing ring.

8. A toothbrush of claim 1, wherein said bar has a stop thereon to prevent the movement of said plunger past said stop.

9. A toothbrush of claim 1, wherein the exterior of said handle has a groove thereon in which said bar is located.

10. A toothbrush of claim 1, further comprising a cap which is removably secured to said handle portion and envelops said brushing member.

* * * * *

UNITED STATES PATENT AND TRADEMARK OFFICE

CERTIFICATE OF CORRECTION

PATENT NO. : 4,421,433

DATED : December 20, 1983

INVENTOR(S) : Gilberto Medrano VILLANUEVA

It is certified that error appears in the above—identified patent and that said Letters Patent is hereby corrected as shown below:

Under item 22 on the title page, insert

--[30] Foreign Application Priority Data

January 28, 1980 [MX] Mexico.....180969--.

Signed and Sealed this

*Fifteenth* Day of *May 1984*

[SEAL]

*Attest:*

GERALD J. MOSSINGHOFF

*Attesting Officer*

*Commissioner of Patents and Trademarks*